US008449312B2

(12) United States Patent
Lang et al.

(10) Patent No.: US 8,449,312 B2
(45) Date of Patent: May 28, 2013

(54) HOUSING WITH A PLURALITY OF WAFERS AND HAVING A NOSE PORTION WITH ENGAGEMENT MEMBERS

(75) Inventors: Harold Keith Lang, Cary, IL (US); Kent E. Regnier, Lombard, IL (US); Jerry A. Long, Elgin, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 13/063,010

(22) PCT Filed: Sep. 9, 2009

(86) PCT No.: PCT/US2009/056321

§ 371 (c)(1), (2), (4) Date: May 26, 2011

(87) PCT Pub. No.: WO2010/030638

PCT Pub. Date: Mar. 18, 2010

(65) Prior Publication Data

US 2011/0230104 A1 Sep. 22, 2011

Related U.S. Application Data

(60) Provisional application No. 61/095,450, filed on Sep. 9, 2008, provisional application No. 61/110,748, filed on Nov. 3, 2008, provisional application No. 61/117,470, filed on Nov. 24, 2008, provisional application No. 61/153,579, filed on Feb. 18, 2009, provisional application No. 61/170,956, filed on Apr. 20, 2009, provisional application No. 61/171,066, filed on Apr. 20, 2009, provisional application No. 61/171,037, filed on Apr. 20, 2009.

(51) Int. Cl.
*H01R 13/627* (2006.01)

(52) U.S. Cl.
USPC ..... 439/352

(58) Field of Classification Search
USPC ..... 439/352–358, 79, 372, 527, 157
See application file for complete search history.

(56) References Cited

U.S. PATENT DOCUMENTS

| | | | | |
|---|---|---|---|---|
| 5,096,441 | A * | 3/1992 | Jaag | 439/676 |
| 6,413,105 | B2 * | 7/2002 | Noro et al. | 439/157 |
| 6,488,543 | B2 * | 12/2002 | Oliphant et al. | 439/676 |
| 7,037,136 | B1 | 5/2006 | Korsunsky et al. | |
| 7,070,446 | B2 * | 7/2006 | Henry et al. | 439/541.5 |
| 7,553,198 | B1 * | 6/2009 | Leddy | 439/701 |
| 7,982,013 | B2 * | 7/2011 | Gurney et al. | 530/387.1 |
| 8,162,675 | B2 * | 4/2012 | Regnier et al. | 439/76.1 |
| 2006/0003632 | A1 * | 1/2006 | Long | 439/608 |
| 2006/0166528 | A1 * | 7/2006 | Hull et al. | 439/79 |
| 2011/0230104 | A1 * | 9/2011 | Lang et al. | 439/676 |
| 2012/0034820 | A1 * | 2/2012 | Lang et al. | 439/660 |

* cited by examiner

*Primary Examiner* — Chandrika Prasad
(74) *Attorney, Agent, or Firm* — Stephen L. Sheldon

(57) ABSTRACT

A connector subassembly is provided that may be utilized for both internal and external applications. The subassembly includes a housing that supports a plurality of wafers with terminals. The housing includes engagement members to secure the housing to either the shield or the guide frame. The engagement members can include an angled portion that allow the housing to form a dovetail joint with the guide frame and/or a multi-faceted portion to engage a fastener.

13 Claims, 15 Drawing Sheets

HOUSING WITH A PLURALITY OF WAFERS AND HAVING A NOSE PORTION WITH ENGAGEMENT MEMBERS

REFERENCE TO RELATED APPLICATIONS

This application is a national phase of international application PCT/US09/56321, filed Sep. 9, 2009 and claims priority to U.S. Provisional Appln. No. 61/095,450, filed Sep. 9, 2008; to Appln. No. 61/110,748, filed Nov. 3, 2008; to Appln. No. 61/117,470, filed Nov. 24, 2008; to Appln. No. 61/153,579, filed Feb. 18, 2009, to Appln. No. 61/170,956 filed Apr. 20, 2009, to Appln. No. 61/171,037, filed Apr. 20, 2009 and to Appln. No. 61/171,066, filed Apr. 20, 2009, all of which are incorporated herein by reference in their entirety. This application was filed concurrently with the following application, which is not admitted as prior art to this application and which is incorporated herein by reference in its entirety:

Application Ser. No. 13/062,984, entitled CONNECTOR WITH IMPEDANCE TUNED TERMINAL ARRANGEMENT.

BACKGROUND OF THE INVENTION

The present invention generally relates to connectors suitable for transmitting data, more specifically to input/output (I/O) connectors suitable for dense connector configurations.

One aspect that has been relatively constant in recent communication development is a desire to increase performance. Similarly, there has been constant desire to make things more compact (e.g., to increase density). For I/O connectors using in data communication, these desires create somewhat of a problem. Using higher frequencies (which are helpful to increase data rates) requires good electrical separation between signal terminals in a connector (so as to minimize cross-talk, for example). Making the connector smaller (e.g., making the terminal arrangement more dense), however, brings the terminals closer together and tends to decrease the electrical separation, which may lead to signal degradation.

In addition to the desire at increasing performance, there is also a desire to improve manufacturing. For example, as signaling frequencies increase, the tolerance of the locations of terminals, as well as their physical characteristics, become more important. Therefore, improvements to a connector design that would facilitate manufacturing while still providing a dense, high-performance connector would be appreciated.

I/O connectors may be used in "internal" applications, for example, where an I/O connector and its mating plug connector are entirely enclosed within a component such as a router, server, switch or the like, or they may be used in "external" application, where they are partially enclosed within a component, but the receptacle portion of the I/O connector communicates to the exterior of the component so that a plug connector may be used to connector that I/O connector to other components. The different designs used in the internal and external connectors tend to raise cost and therefore certain individuals would appreciate an improved connector design.

SUMMARY OF THE INVENTION

An I/O subassembly is provided that may be utilized for both internal and external applications. In an external application, a shield can enclose and support the subassembly. In internal applications, a guide frame can support the subassembly. The subassembly includes a plurality of wafers that are supported by a housing. Each wafer may include an insulative frame that supports multiple terminals so as to provide one or more card-receiving slots. The housing includes a first and second engagement member to secure the housing to either the shield or the guide frame. In an embodiment, the first engagement member has angled portions that allow the housing to form a dovetail joint with the guide frame and the second engagement member has a multi-faceted portion to engage a fastener provided in the external application. The multi-faceted portion may be positioned adjacent an angled portion so that the multi faceted portion serves primarily as stop surface while the angled portion allows the housing to form a dovetail joint with the guide frame.

BRIEF DESCRIPTION OF THE DRAWINGS

Throughout the course of the following detailed description, reference will be made to the drawings in which like reference numbers identify like parts and in which.

DETAILED DESCRIPTION OF THE ILLUSTRATED EMBODIMENTS

As required, detailed embodiments of the present invention are disclosed herein; however, it is to be understood that the disclosed embodiments are merely exemplary of the invention, which may be embodied in various forms. Therefore, specific details disclosed herein are not to be interpreted as limiting, but merely as a basis for the claims and as a representative basis for teaching one skilled in the art to variously employ the present invention in virtually any appropriate manner, including employing various features disclosed herein in combinations that might not be explicitly disclosed herein.

It has been determined to be desirable to have an I/O connector with structure that permits it to be used in either an internal or external application, so as to reduce manufacturing costs and the need to maintain multiple connector products to fit multiple applications. It has been determined that this can be accomplished by provide a subassembly that is compatible with external and internal supports.

Figure 1:
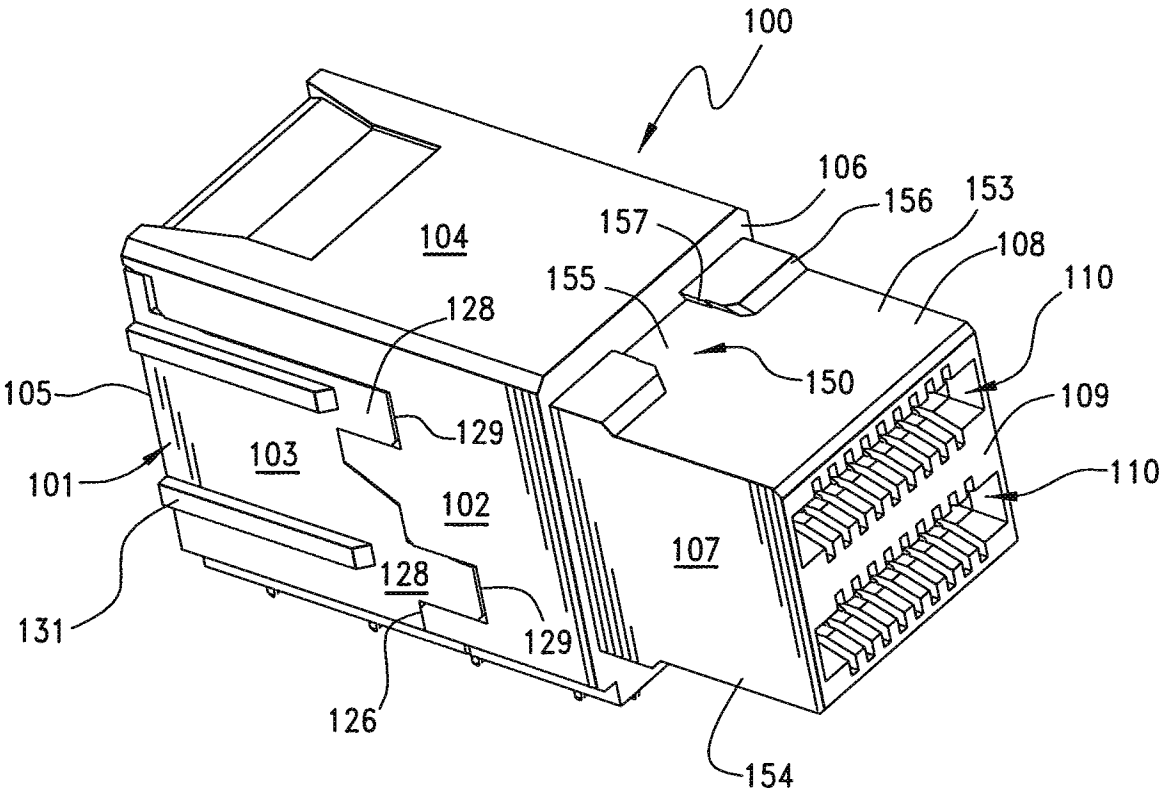
FIG. 1 is a perspective view of an embodiment of a subassembly.

FIG. 1 illustrates an embodiment of a subassembly 100. The subassembly 100 takes the form of an insulative housing 101 which is illustrated as having two interengaging first and second (or front and rear) pieces, or parts 102, 103. The housing 101, as shown in FIG. 1 has a wide body portion 104 that extends between a rear face 105 and the front face 106 and a mating portion 107 that takes the form of an elongated nose portion 108 projects forwardly of the front face 106 and terminates in a mating face 109. The mating face 109 may have one or more circuit card-receiving slots 110 that are formed widthwise in the mating face 109, with two such slots 110 being shown in FIG. 1. The housing 101 further includes a mounting face 111.

As shown in FIGS. 2-5, the housing 101 has a hollow interior portion 112 that receives a plurality of terminal assemblies 114 that take the form of a wafer 115. Each such wafer 115 contains a plurality of conductive terminals 116 having tail portions 117 projecting out from one edge 118 of the frame 115 and contact portions 119 projecting from a second edge 120 of the frame 115. In the illustrated embodiment, the two edges 118, 120 are adjacent each other, but it is envisioned that in certain applications, the contact and tail portions could lie along opposite edges of the frame 15. The terminals 116 further include body portions 121 that interconnect the tail and contact portions 117, 119 together. The terminal assembly frames 115 may have openings 123 formed therein in the form of slots that extend along the terminal body portions 121 to expose them to air and thereby affect the terminal impedance.

Figure 4:
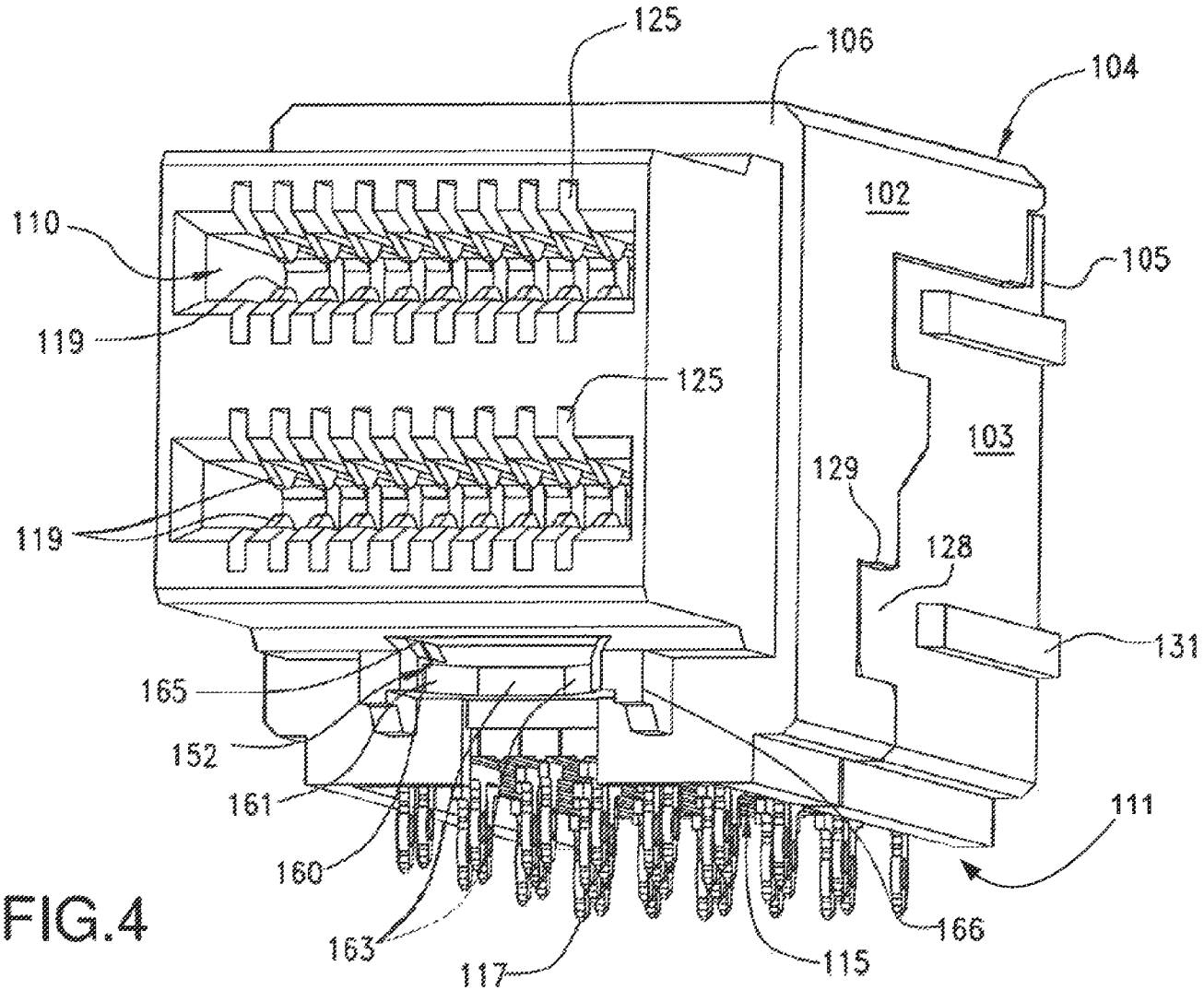
FIG. 4 is a frontal perspective view of the subassembly of FIG. 1.
Figure 5:
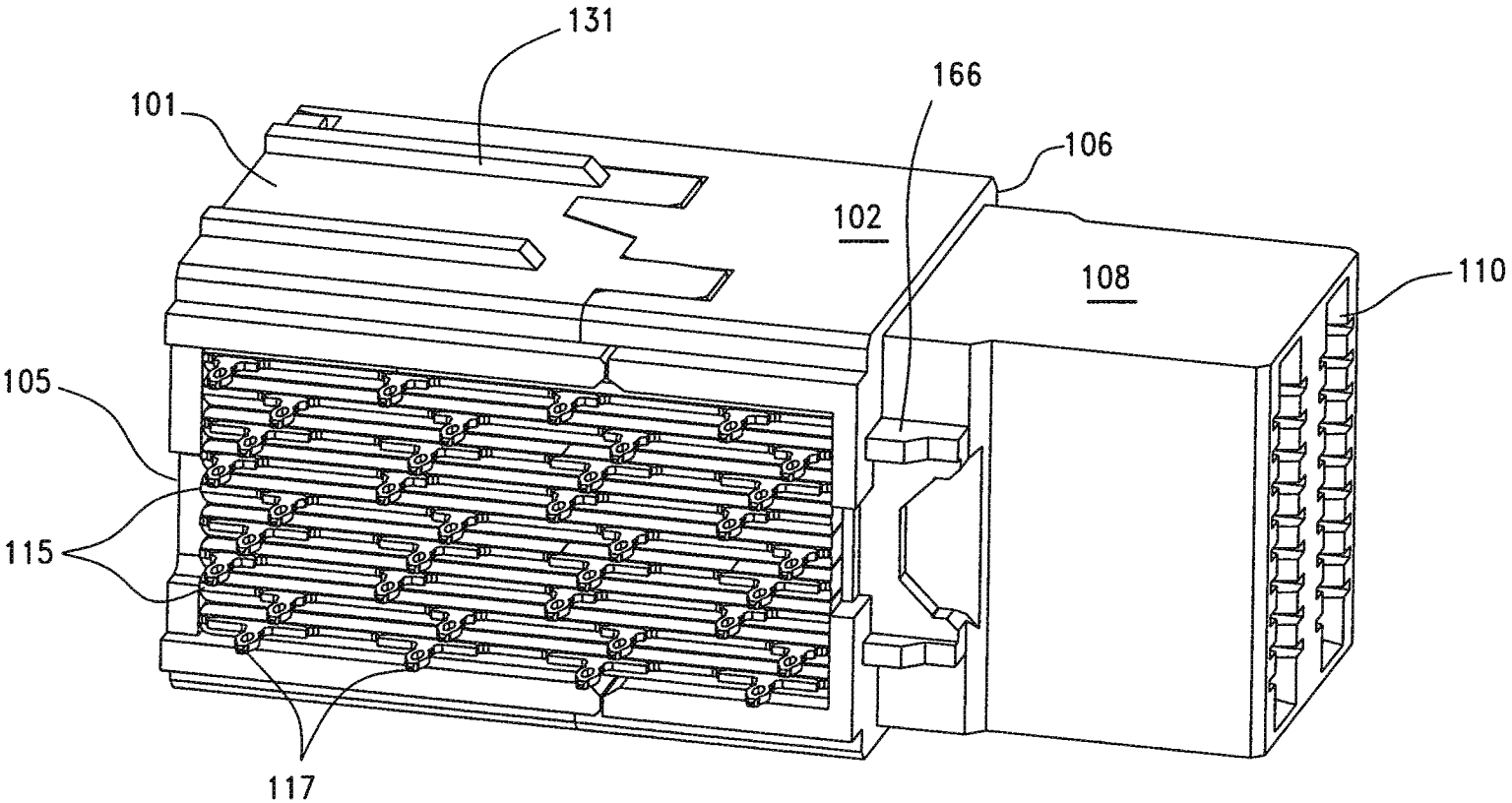
FIG. 5 is a perspective view of the subassembly laying on its side illustrating the arrangement of the terminal tails portions.

The wafers 115 are held together as a group, or block, within the housing 101 in a manner such that the terminal tail portions 117 extend out through the bottom of the housing 101 and the terminal contact portions 119 extend from the edges 120 of their frames 115 into the housing nose portion 108. The contact portions 119 are arranged in the frames 115 as pairs of terminals and each pair is contained within and on opposite sides of one of the card-receiving slots 110. (FIGS. 2 & 4.)

Figure 2:
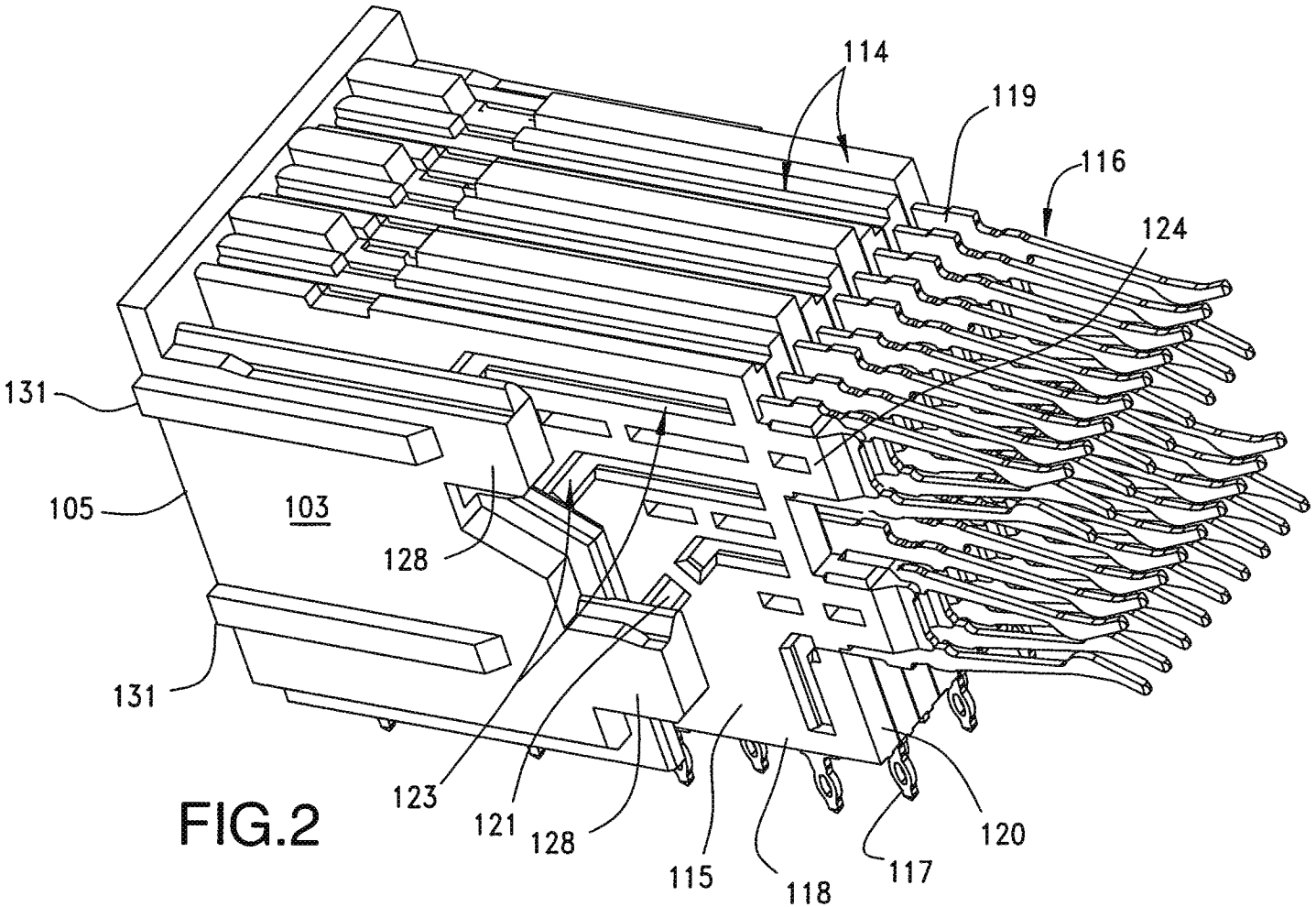
FIG. 2 is the same view as FIG. 1, but with the front housing part removed for clarity, illustrating the terminal assemblies in place as a block within the rear part of the subassembly.
Figure 3:
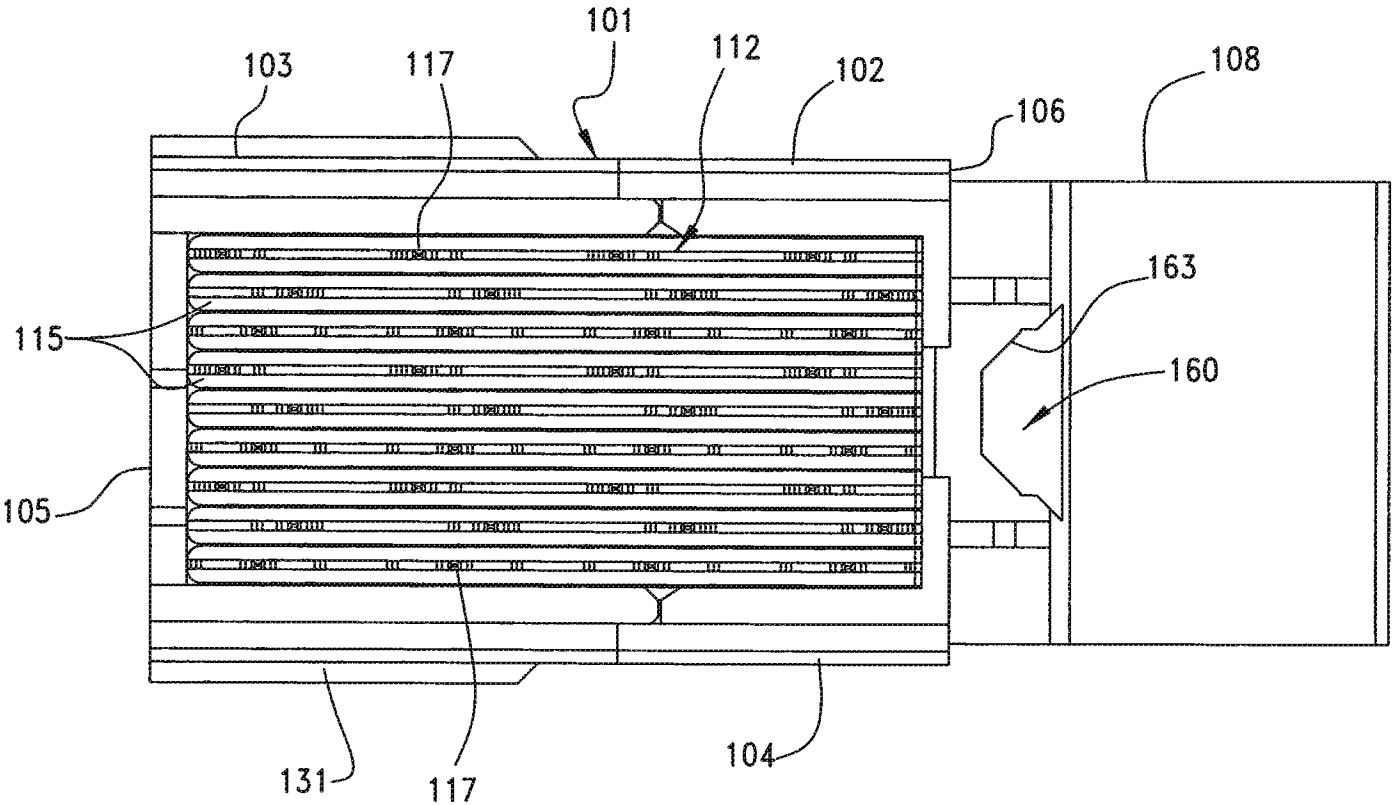
FIG. 3 is a bottom plan view of the subassembly of FIG. 1.

As can be understood from the drawings, particularly FIG. 2, the contact portions 119 are cantilevered in their structure and act as contact beams that deflect away from the slots 110 when a circuit card is inserted therein. In order to accommodate this upward and downward deflection of the contact portions 119, the nose portion 108 of the housing 101 has terminal-receiving cavities 125 that extend from a vertical preselected above and below centerlines of each slot 110.

Returning to FIGS. 1 & 2, the housing 101 has its two pieces 102, 103 mate along an irregular mating line 126 that extends upwardly through the sides of the housing 101 along a path that extends from front to rear of the housing 101. This irregular mating line facilitates the molding of the housings and it is explained in greater detail in U.S. Provisional Patent Application No. 61/122,102, filed Dec. 12, 2008 for "Two-Piece Thin Wall Housing," the disclosure of which is hereby incorporated herein by reference. The two housing parts 102, 103 interlock together, or engage, each other along this irregular and non-linear mating line 126.

With this irregular configuration, a pair of rails 128 and channels 129 are defined in the two housing pieces 102, 103 with the rails 128 fitting into the channels 129. Outer ribs 131 may also be formed on the exterior side surfaces of the rear housing part 103 and these ribs 131 are preferably horizontally aligned with the rails 128 to provide reinforcement to the rails 128, but also to provide a means for positioning the subassembly 100 in an exterior shroud as will be described in greater details to follow.

In an embodiment, the housing 101 is configured so that it may fit within a guide frame and a shield. Turning now to FIGS. 7-12, an embodiment of a guide frame 300 that is mounted to a circuit board 301. This guide frame 300 is helpful because it can be mounted on a circuit board within an electronic component, such as a router or server, and the guide member 300 serves to guide a mating plug connector into engagement with the car-receiving slots of the subassembly 100. Since the guide frame is typically positioned within a shielded component, it is referred to as an internal application.

The guide frame 300 is preferably molded from a dielectric material such as a resin and may include one or more metal reinforcement members therein at selected locations. The guide frame 300 takes the form of a four-walled frame 302 which is mounted to a circuit board 301 and which has multiple columns and cross-pieces which are joined together to define one or more hollow interior openings 310 in which the connectors 100 are received. It may include a pair of columns, or sidewalls, 304, 305, a bottom cross-piece, or wall 306 and a top cross-piece, or wall 307 which are joined together to form a square or rectangular structure and which cooperatively define an opening or openings 310 which extending through the guide frame 300. Each such opening 310 preferably receives an individual subassembly 100 therein in such a manner such that the shroud walls 304-307 surround the nose portion 108 of the housing 101. The columns 304, 305 have wider portions 304', 305' that are set back rearwardly of the openings 310.

Figure 7:
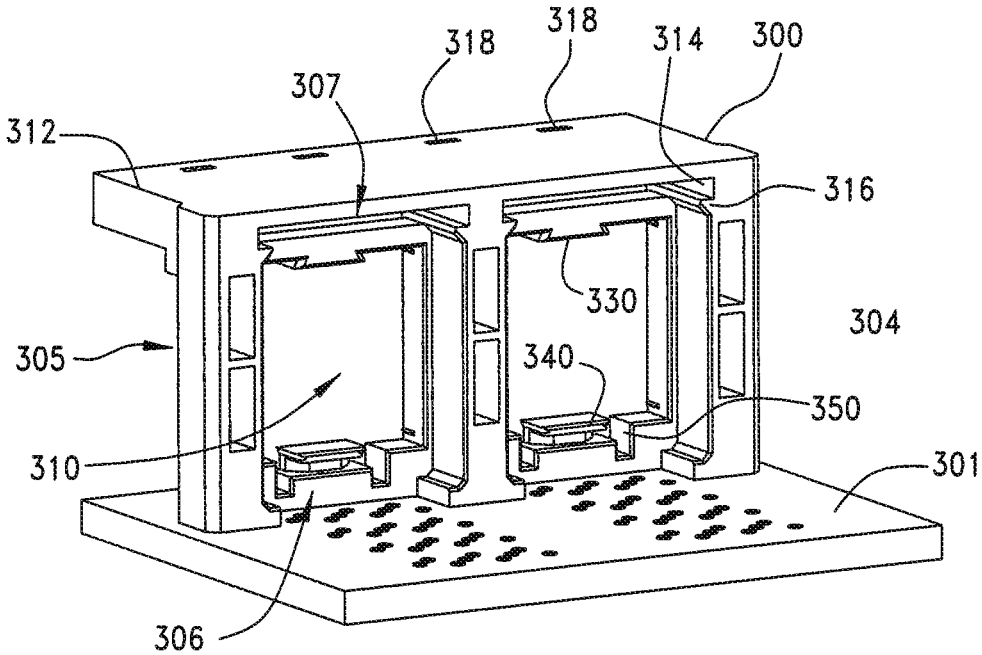
FIG. 7 is a perspective view, taken from the rear, illustrating a guide frame which may be used in association with the subassembly of FIG. 1 and which is shown mounted to a circuit board.
Figure 8:
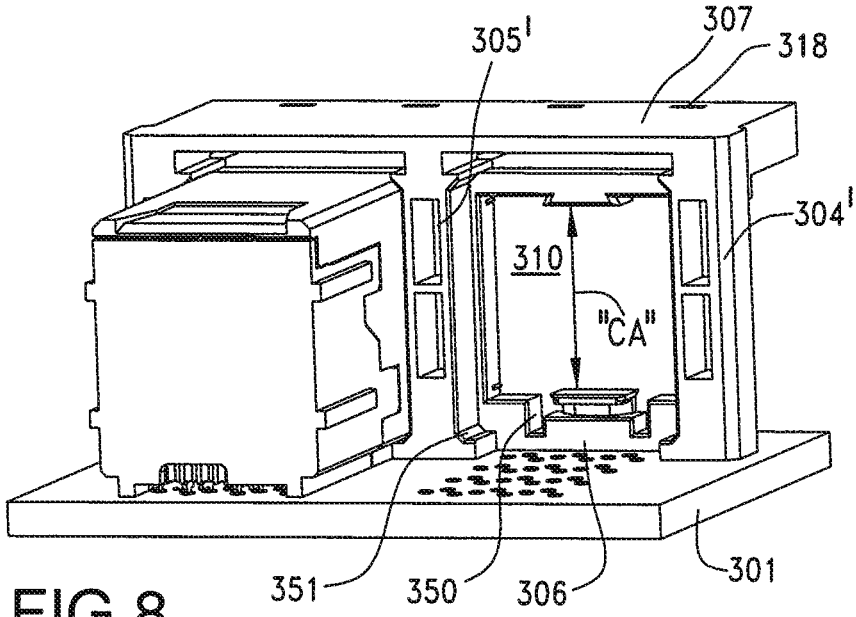
FIG. 8 is a perspective view, taken from the rear, of a subassembly inserted in place into a guide frame mounted to a circuit board.
Figure 9:
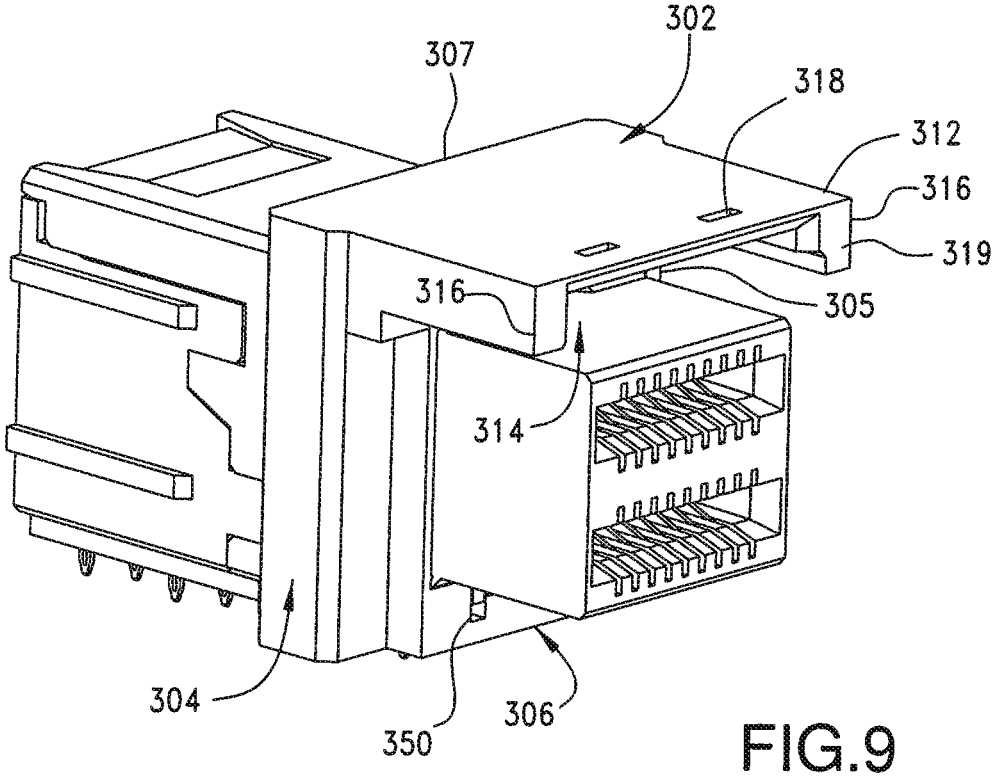
FIG. 9 is a perspective view, taken from the front, of a subassembly inserted into the guide frame of FIG. 7.
Figure 10:
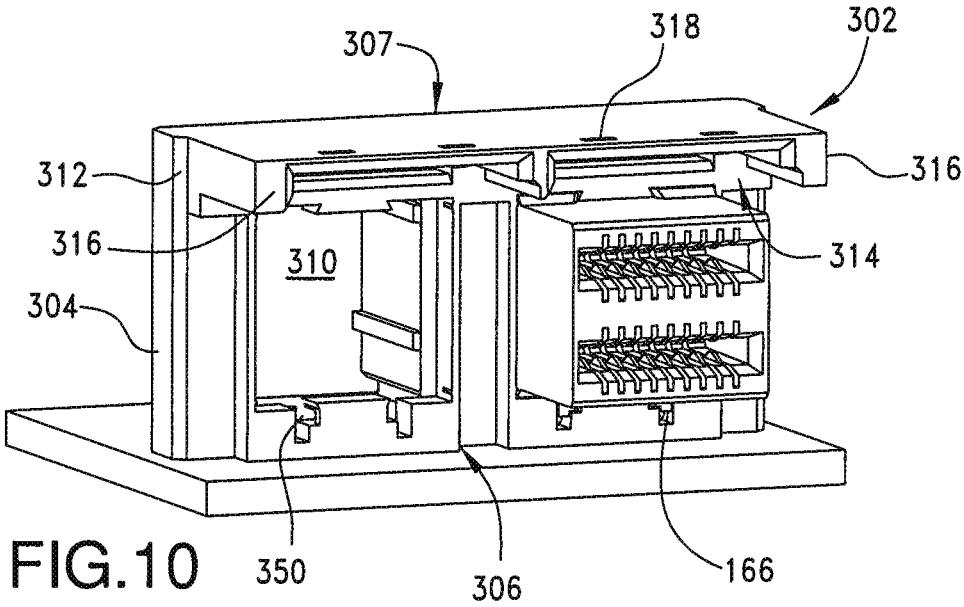
FIG. 10 is a perspective view showing a tandem-style guide frame mounted to a circuit board and with a subassembly inserted in an openings.
Figure 11:
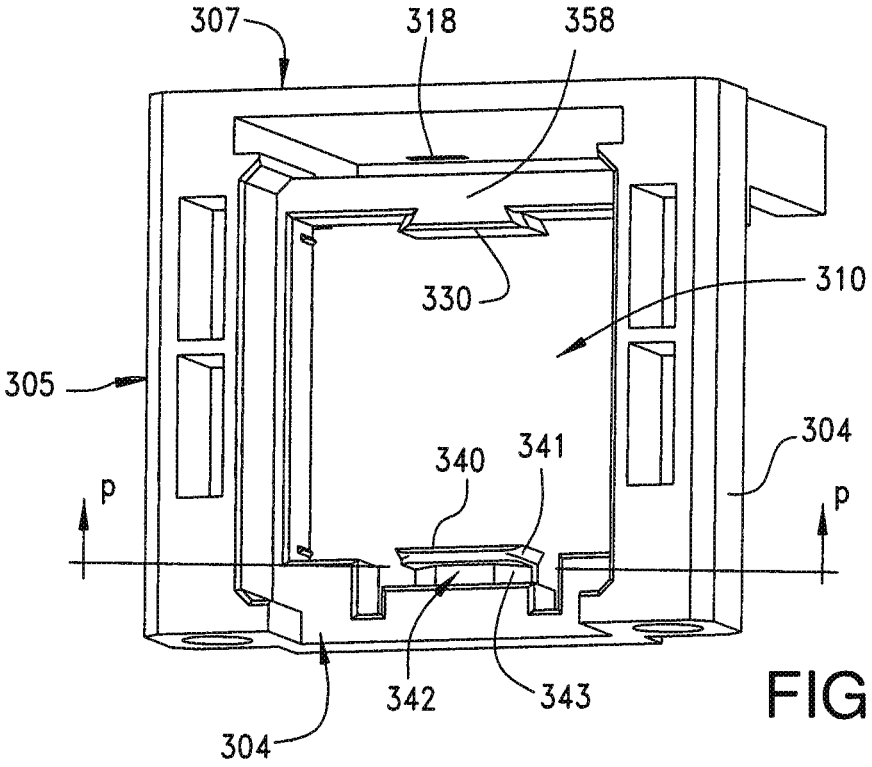
FIG. 11 is a perspective view of a guide frame, taken from a low viewing point.

The guide frame 300 may also include a mating ledge, or flange, 312 that extends out forwardly and horizontally from the top wall 307. This flange 312 is primarily used for interacting with an opposing plug connector and thereby may include a widthwise slot 314 (FIG. 9.) defined in part by two shoulders 316 that are spaced apart from each other along the front surface 317 of the top wall 307. This slot 314 preferably receives a key on the opposing mating connector (not shown) to ensure proper mating with the subassembly 100. The flange 312 may also include one or more recesses, or cavities 318, which are disposed near the front edge 319 of the flange 312 and which are spaced apart widthwise of the shroud flange 312. These cavities 318 are positioned so as top be engaged by corresponding engagement hooks, or members, which are formed on the opposing mating plug connector. The guide frame 300 may be formed to engage a single subassembly 100 as shown in FIGS. 9 & 11, or it may have a ganged structure that engages multiple connector subassemblies 100 as shown in FIGS. 7, 8 and 10.

In order to properly position the subassembly 100 in place in the guide frame 300, the guide frame 300 is provided, as illustrated, with two retention members 330, 340 that are respectively disposed on opposing top and bottom edges of the shroud opening 310. The top retention member 330 extends downwardly in the opening 310 and has an angled portion that dovetails with the subassembly 100. Similarly, the bottom retention member 340 also has a angled feature but is composed of two sections, a top section 341 and a bottom section 342. The top section 341 is angled but is oriented in an inverted fashion with respect to the top retention member 330, i.e. the top portion is wider than the bottom portion thereof. The bottom retention member bottom section 342 has a plurality of flat surfaces 343 (five such surfaces being shown in the drawings) that are angularly disposed with respect to each other and form the general shape of a half-hexagon or half-octagon. These flat surfaces 343 abut against corresponding opposing surfaces formed in the housing 101 to hold the housing 101 in place in the guide frame 300. As shown in FIG. 8, these two retention members 330, 340 are preferably aligned with each other along a common axis "CA", but in some instances, they can be offset from each other.

Figure 6:
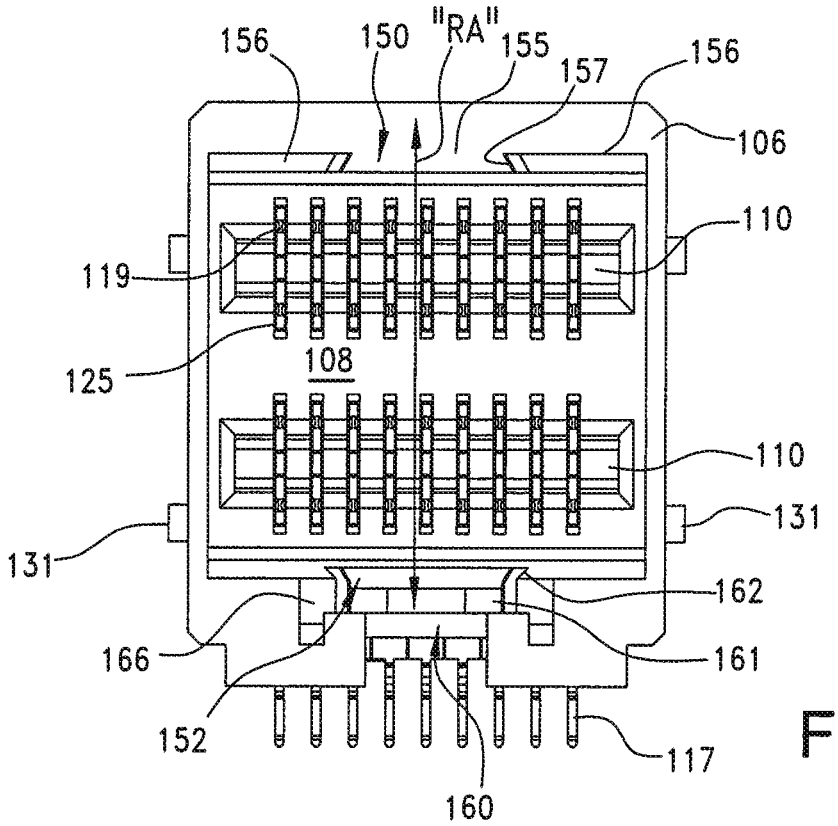
FIG. 6 is a front elevational view of the subassembly of FIG. 1.

In order to engage the guide frame 300, the housing 101 of the subassembly 100 is preferably provided with a first and second engagement member 150, 152. These are shown best in FIGS. 1-2, 4 and 6. They can be located on opposing top and bottom surfaces 153, 154 of the nose portion 108 and the top engagement member 150 can take the form of a recess 155 that extends widthwise between two shoulder portions 156 that are disposed on the top surface 153 of the nose portion 108. The inner opposing edges 157 are angled so as to dovetail with the guide frame 300 (FIG. 6). Thus the top engagement member has an angled portion.

Similarly, the housing 101 also includes a second engagement member 152, also in the form of a recess 160 that is disposed on the bottom surface 154 of the housing nose portion 108. This recess 160 is preferably aligned with the upper recess 155 along a common, vertical axis RA. (FIG. 6.) The bottom recess 160 has two distinct sections 161, 162. It has a hollow base portion 161 that is arranged on its bottom and this hollow base portion 161 has a plurality of flat surfaces (i.e., multi-faceted) 163 that are regularly disposed adjacent each as shown best in FIG. 2. The flat surfaces 163 are interconnected together to form a half-octagonal opening (FIG. 3) and they abut the confronting flat surfaces 343 of the bottom retention member 340 of the internal guide frame 300 when the subassembly 100 is fully inserted into the guide frame 300. These flat surfaces 163, 343 resist relative rotation of the housing 101 with respect to the internal guide frame 300. It can be seen that the top and bottom (first and second) retention members 330, 340 are similar in configuration, both are somewhat dovetailed and are wider at their ends than at their bases, but are inverted with respect to each other, i.e. the top member is wider at its bottom end whereas the bottom member is wider at its top end.

Figure 12:
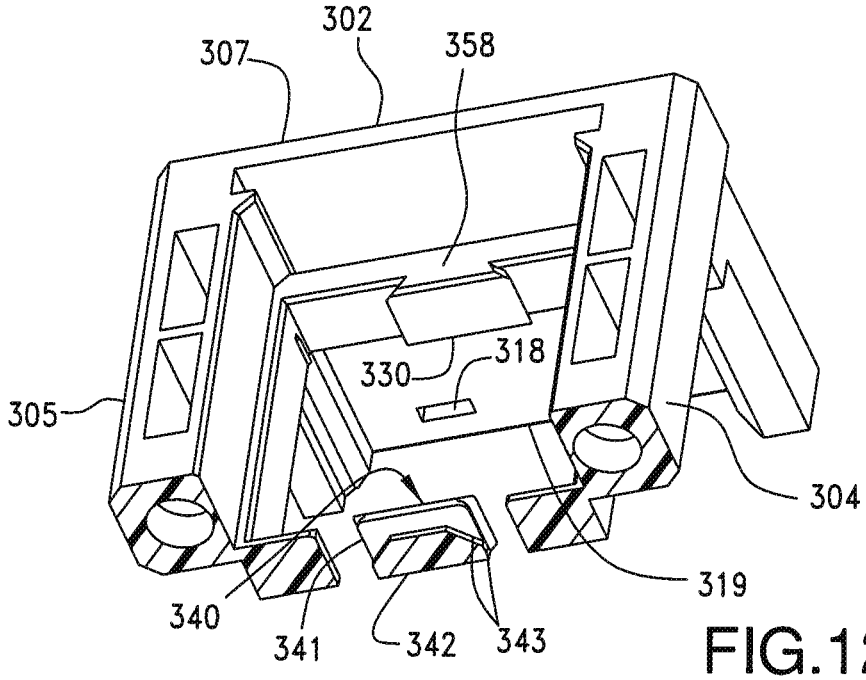
FIG. 12 is a view of the guide frame of FIG. 11, that has been sectioned along line P-P thereof to show the multi-faceted retention member on the bottom of the guide frame.

The bottom recess 160 of the housing 101 further includes a top section 162 that is adjacent the hollow base portion 161, and it takes the form of a widthwise slot 165 that communicates with the bottom section 161. As shown in FIG. 6, this slot 165 has an angled configuration (so as to allow the dovetail joint), and it is inverted as compared to the top recess 156, i.e., it is wider at its top edge than at its bottom edge. Two legs 166 may be provided that flank the bottom recess 152 and they serve to provide structural support for the molding of the bottom engagement member 152 and they may also project forwardly along the bottom of the housing 101. These legs 166 are received in two channels 350 that are formed in the bottom wall 306 of the internal guide frame 300. (FIG. 12.) Additional engagement points such as shoulders 351 that bear against the housing 101 may be provided on the internal guide frame 300.

The front face 106 of the housing 101 provides a stop surface that contacts the rear surface of the shroud top retention member 330 to fix the location of the housing 101 in the shroud while the flat surfaces 163 of the housing bottom recess 160 provide a similar stop surface function. Similarly, the angled surfaces of the dovetailed sections of the top and bottom recesses 155, 160 serve to deter side and vertical movement of the subassembly 100. It can be seen that the retention members of the internal guide frame 300 and the engagement members (recesses 155, 160) of the housing 101 cooperatively form a means for reliably engaging the shroud and subassembly together.

Figure 13:
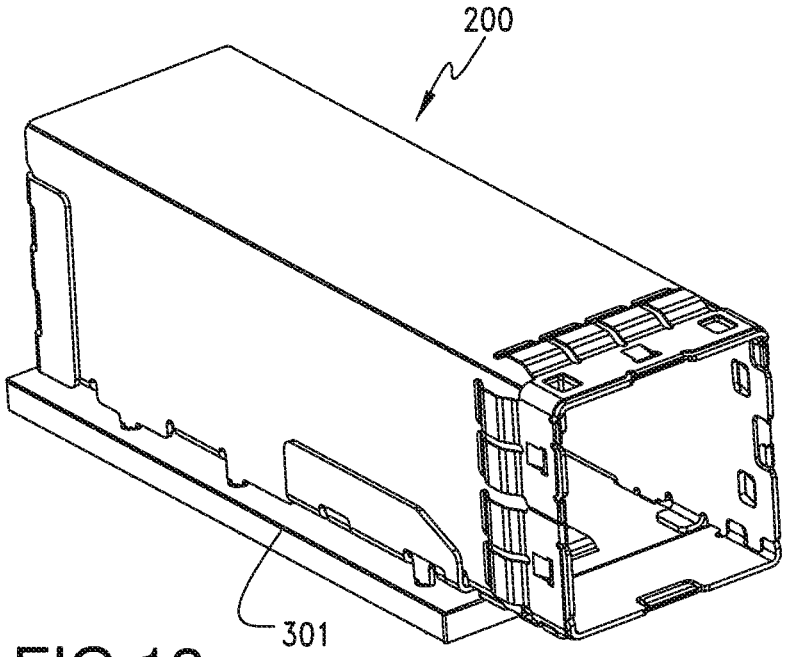
FIG. 13 is a perspective view of a shield into which a subassembly has been fitted.
Figure 14:
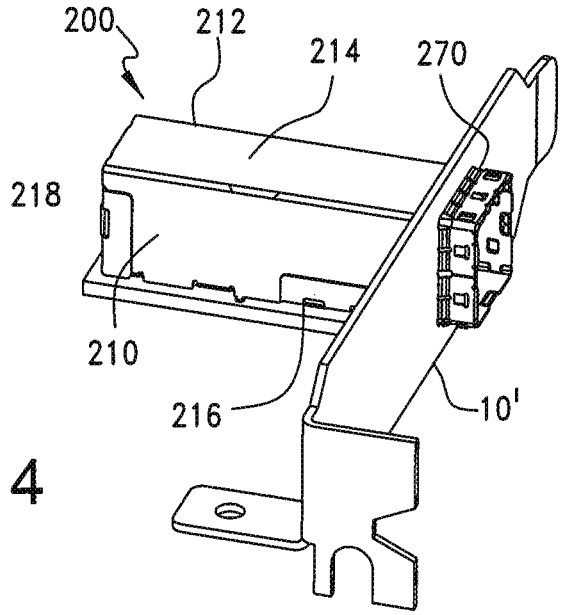
FIG. 14 is a perspective view of the shield of FIG. 13 inserted onto a mounting plate, illustrating the external access to the subassembly.
Figure 15:
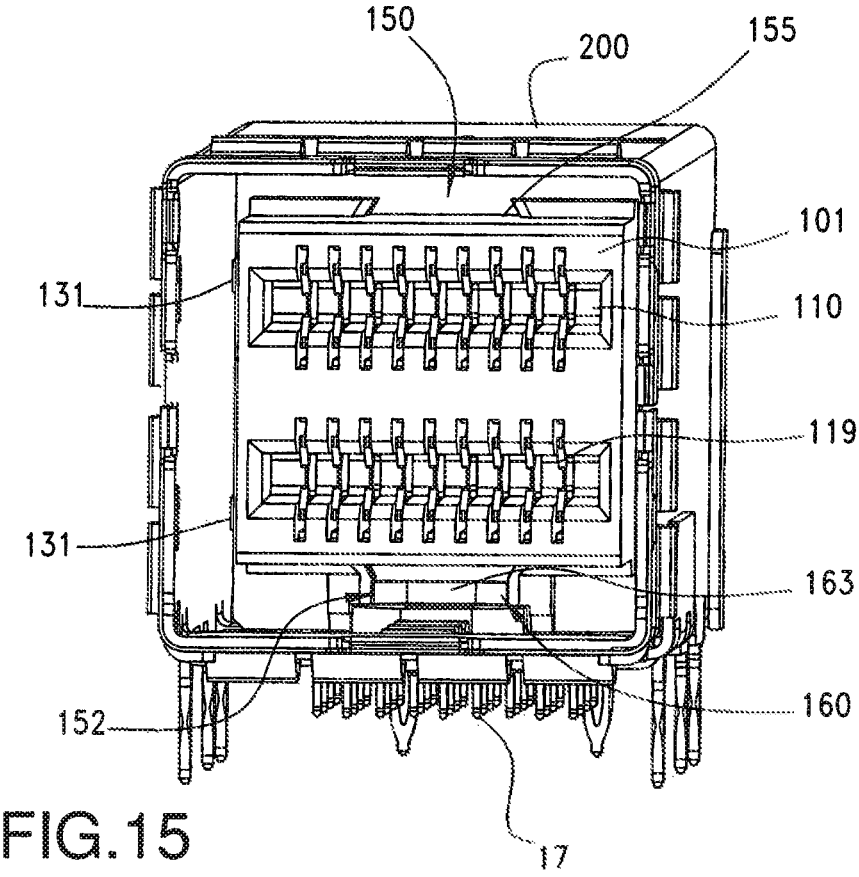
FIG. 15 is an enlarged front elevational view of the shield of FIG. 13 with the subassembly in place therein.
Figure 16:
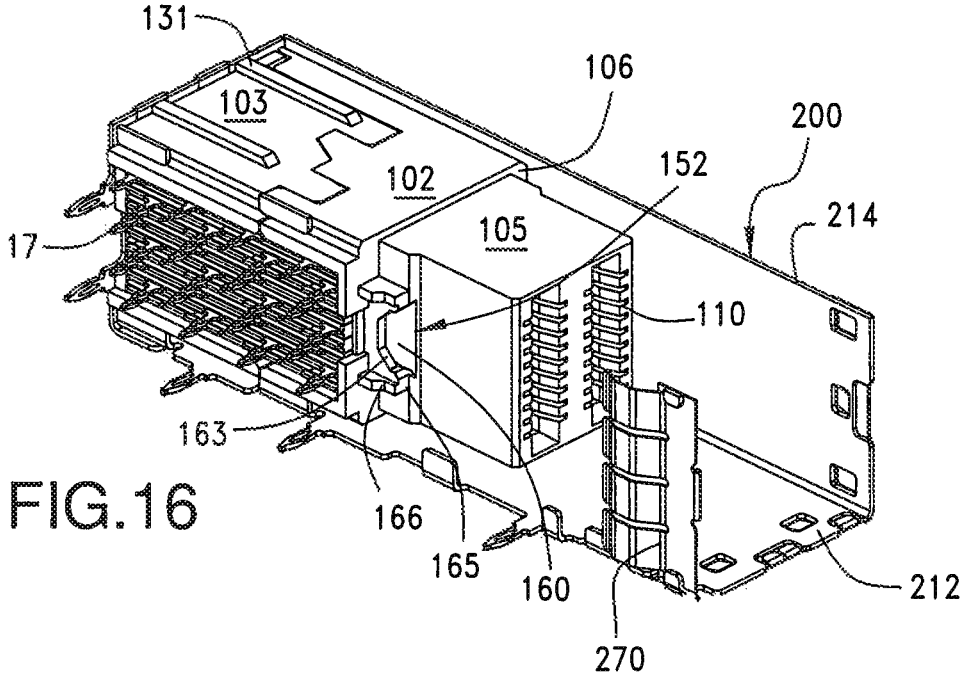
FIG. 16 is a perspective view of the shield with a side wall removed to show the subassembly inside for clarity.
Figure 17:
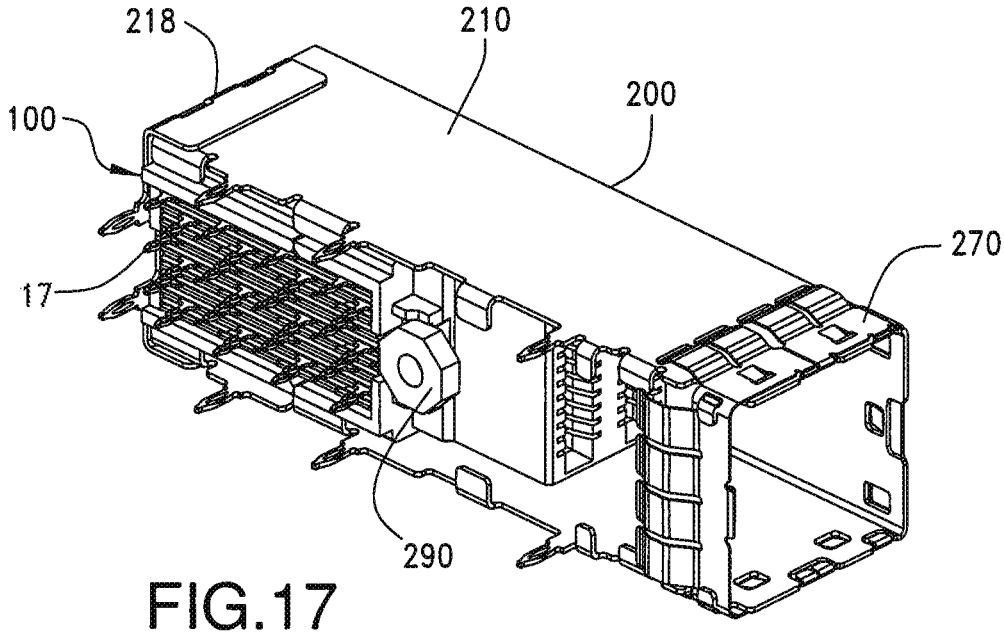
FIG. 17 is the same view as FIG. 16, but with a shield sidewall in place and a bottom wall removed for clarity showing the retention nut in place in the subassembly bottom recess.
Figure 18:
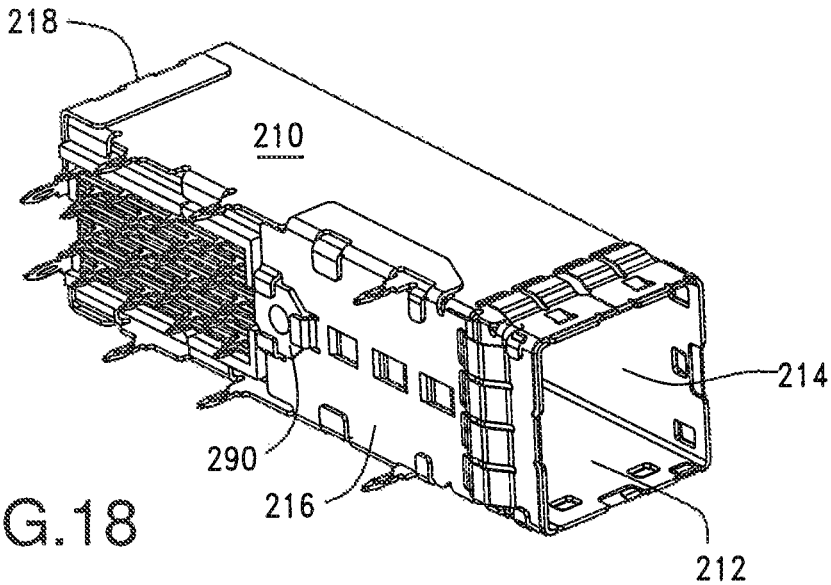
FIG. 18 is the same view as FIG. 17, but with the shield bottom wall in place.

The structure of the housing 101 can also engage a shield, such as a shield 200 shown in FIGS. 13 & 14. The shield is typically used to mount the subassembly 100 in alignment with a face plate 10' and provides an opening that exposes the housing 101 to an exterior of the electronic component. (FIG. 14.) The shield 200, therefore takes the form of a multi-walled structure that has a hollow interior and which substantially envelopes the subassembly 100 except for part of its bottom area from which the terminal tail portions 117 project. Due to the depicted structure of the subassembly 100 and the shield 200, the subassembly 100 is inserted into the shield 200 to form an assembly that is attached to the circuit board 301, rather than being placed on the circuit board 301 and then having the shield 200 placed over it.

In this arrangement, the bottom engagement recess 152 of the housing 101 will contact and engage a fastener (FIGS. 15-20) that is used to fasten the shield 200 to a circuit board 301 by way of a mating fastener (not shown). The exterior ribs 131 of the housing 101 (FIG. 1) also will preferably frictionally engage the inner side walls of the shield 200 to provide a means of centering the housing 101 within the hollow interior of the shield 200.

Figure 19:
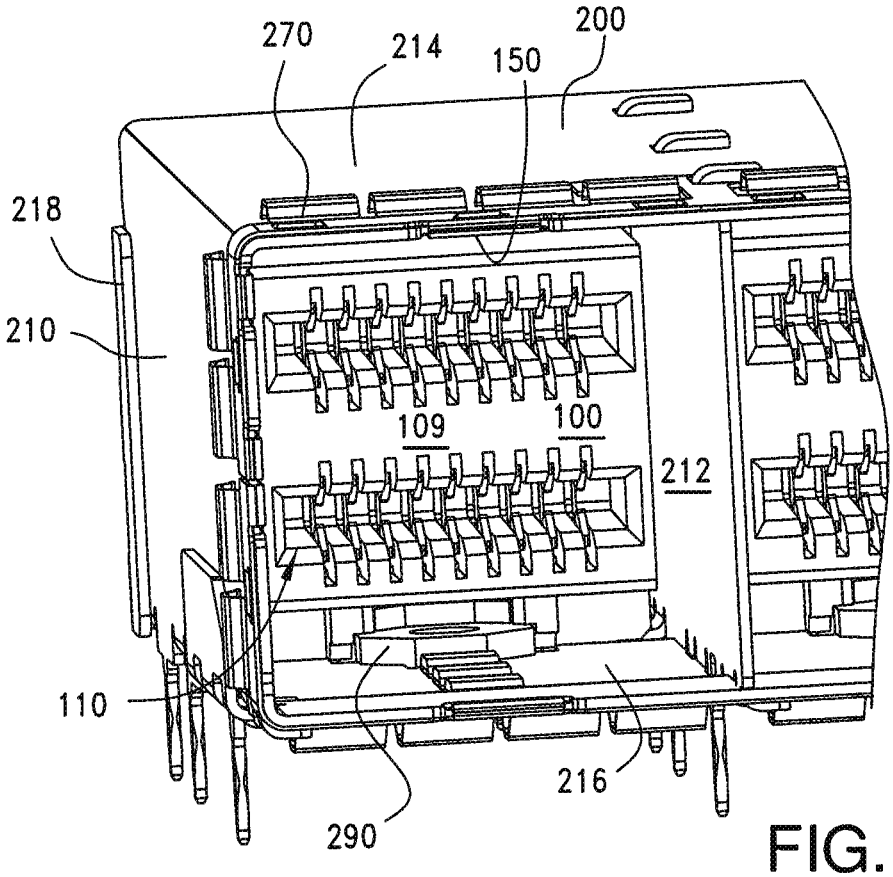
FIG. 19 is an enlarged detailed perspective view taken from the front of a shield showing the interior thereof.
Figure 20:
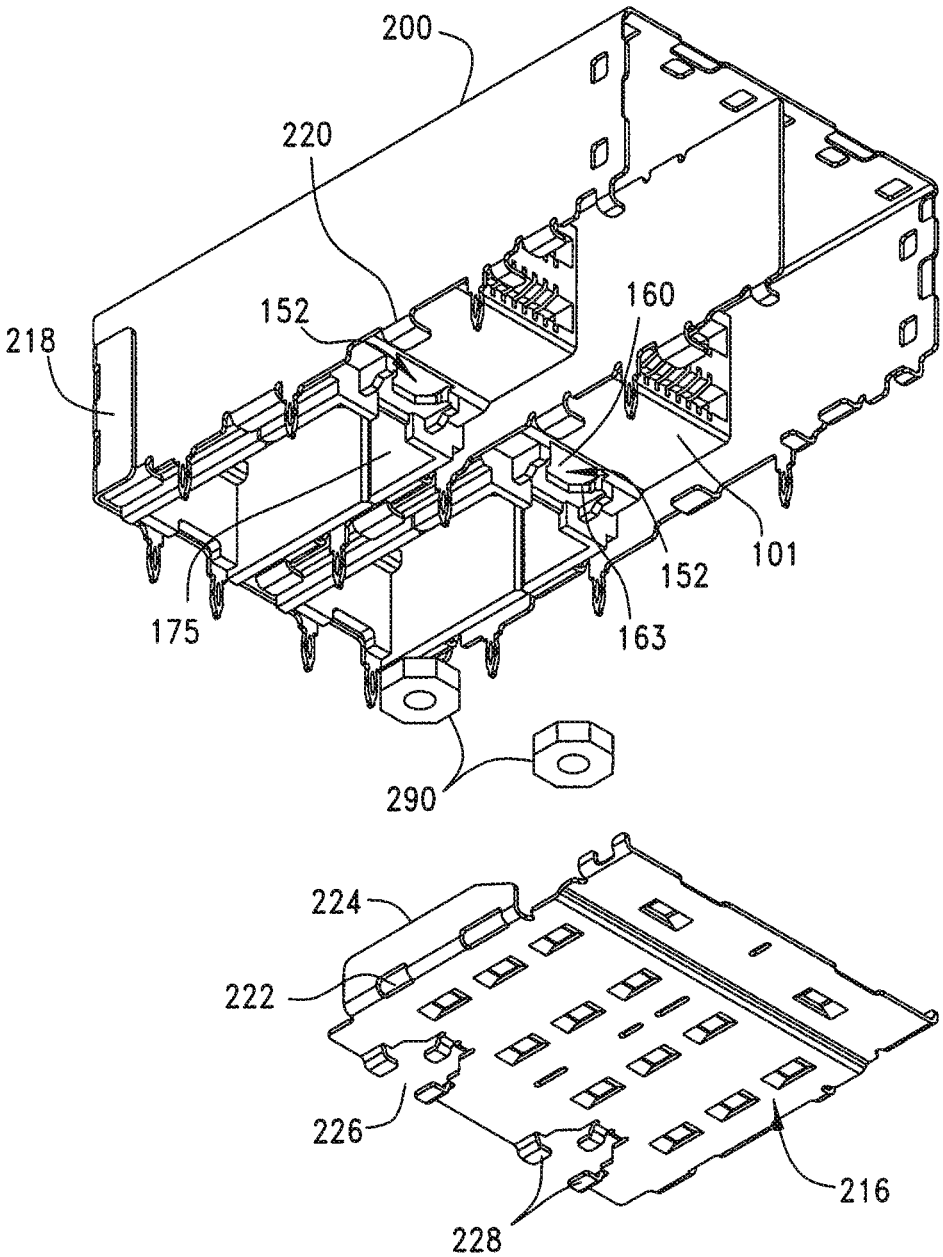
FIG. 20 is a perspective view of an alternate embodiment of a shield that receives two adjacent housings of the invention in a pair of adjacent bays.
Figure 21:
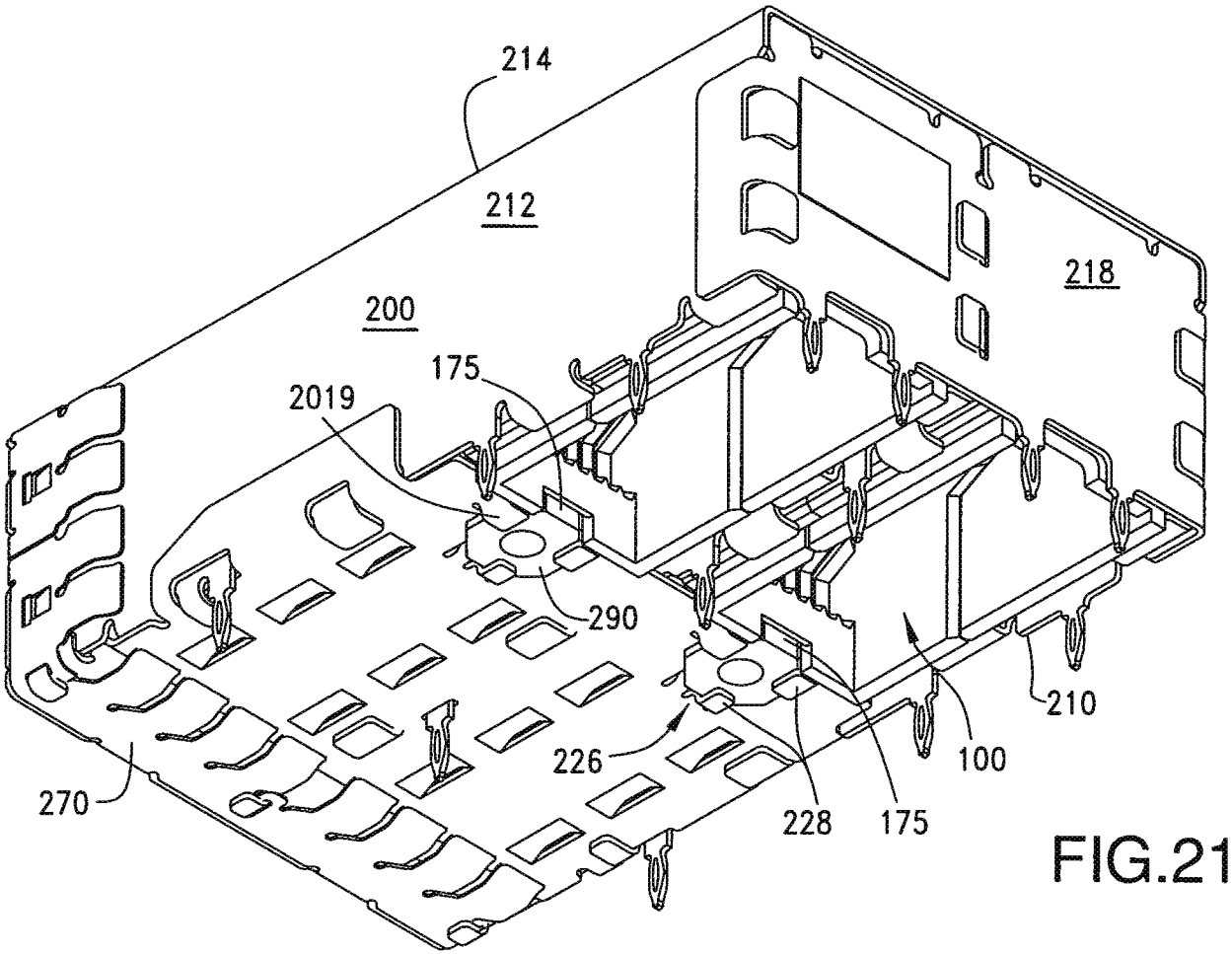
FIG. 21 is an exploded perspective view of a ganged shield with a bottom wall and fasteners; and, FIG. 22 is an enlarged detail elevational view, illustrating the engagement between the fastening nut and a subassembly.

The shield 200 is shown mounted to a bracket 10' that engages EMI gasket 270. The shield 200 has a plurality of walls, such as two opposing side walls 210, 212, a top wall 214, a bottom plate 216 and a rear wall 218. The EMI gasket is affixed to the front end of the shield and has a plurality of spring arms or fingers that are contacted by the bracket. In an embodiment, the connector may include a threaded member 290, which may be an internally threaded member, such as a threaded nut 290, that is supported by the shield 200, by way of the bottom plate 216 thereof and provides a means by which to fasten the subassembly 100 and shield 200 as an assembly to a circuit board 301. The shield may be modified to from a gang structure of ports, as illustrated in FIGS. 19-21. In such a configuration, a fastening nut 290 can be captured in place by the shield in each port and one end of the nut is presented in the rearward direction as a contact surface which engages the subassembly 100.

Figure 22:
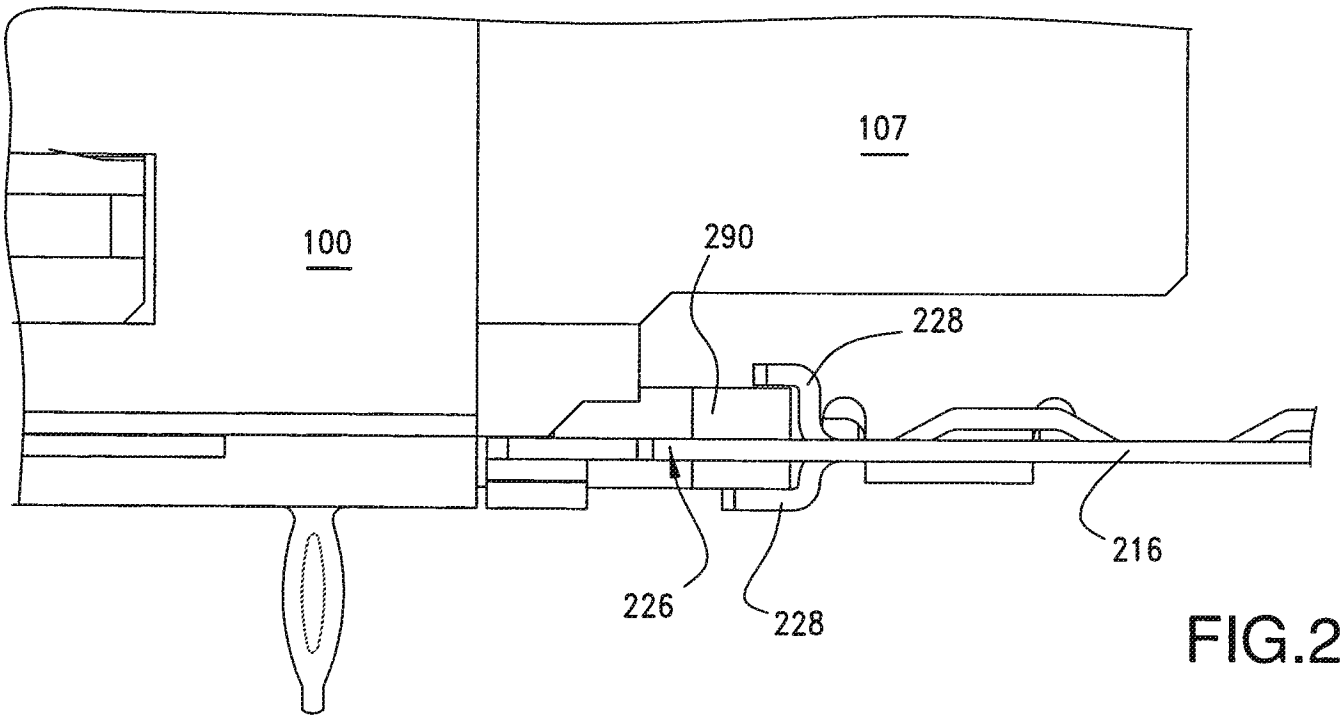

In this regard, the fastener (which can be any desirable fastener) is configured so that insertion of the connector in a forward direction within the shield 200 is limited by the connector's engagement with the fastener (or threaded member) 290. Such structure allows at least three points of contact 290*a*, 290*b*, 290*c* between the threaded member 290 and the housing 101 so that the position of the connector is controlled along two axis, running longitudinally and transversely. The shield 200 may include a plurality of tabs 220 formed along the bottom edges of it that are received within slots 222 formed in the bottom plate 216 along the edge where portions of the bottom plate 216 are bent upwardly to form upright flanges 224. The bottom plate is further provided with a notch 226 that has a configuration complementary to that of the threaded member, fastening nut 290 and further includes a plurality of tabs 228 disposed around the notch that serve to hold the fastening nut 290 in place on the shield bottom plate 216. These tabs 228 preferably extend above and below the fastening nut 290 as shown in FIG. 22 to hold it in place. The subassembly 100 may further include a cutout 175 (FIGS. 3 & 21) along a bottom edge thereof into which an end of the fastening nut 290 may extend, as shown.

It should be noted that while detailed features regarding embodiments of guide frames and shield have been disclosed, these features are not intended to be limiting unless otherwise noted. Notably, a subassembly can be configured to engage provided features of both a guide frame and a shield so as to allow flexibility in installing the subassembly in either internal or external applications.

It will be understood that there are numerous modifications of the illustrated embodiments described above which will be readily apparent to one skilled in the art, such as many variations and modifications of the compression connector assembly and/or its components including combinations of features disclosed herein that are individually disclosed or claimed herein, explicitly including additional combinations of such features, or alternatively other types of contact array connectors. Also, there are many possible variations in the materials and configurations. These modifications and/or combinations fall within the art to which this invention relates and are intended to be within the scope of the claims, which follow. It is noted, as is conventional, the use of a singular element in a claim is intended to cover one or more of such an element.

What is claimed is:

1. A subassembly, comprising:

a housing having a mounting face, a front face, a nose portion extending from the from face, a mating face on the nose portion, the nose portion further including a first side and a second side that extend from the front face to the mating face, the mating face having a first card receiving slot and a second card receiving slot, the housing having an opening in the mounting face and having a first engagement member and a second engagement member, the first and second engagement members positioned on the first and second sides; and a plurality of wafers disposed in the housing, each wafer including a plurality of conductive terminals, the terminals having tail portions that extend out of the opening in the mount face, the terminals have contact portions that are positioned in the first and second card-receiving slots, wherein the housing encloses the wafers on four sides.

2. The subassembly of claim 1, wherein the first and second sides are on opposing surfaces of the nose portion.

3. The subassembly of claim 2, wherein the first engagement portion is angled and configured to form a dovetail, joint with a guide frame.

4. The subassembly of claim 3, wherein the second engagement portion is multi-faceted and configured to engage a plurality of sides of a fastener.

5. The subassembly of claim 4, wherein the second engagement portion includes at least three flat surfaces.

6. The subassembly of claim 3, the second engagement portion includes an angled portion configured to form a dovetail joint with a guide frame.

7. The subassembly of claim 1, wherein the first engagement portion is positioned on a top side of the nose portion and the second engagement portion is positioned on a bottom side of the nose portion.

8. A subassembly, comprising:

a plurality of wafers, each wafer including an insulative frame and a plurality of conductive terminals supported by the frame, the terminals having tail portions extending along one side of the wafer and contact portions extending along and out from a second side of the wafer; and a housing formed of insulative material and having a body portion and a nose portion projecting forwardly from the body portion, the housing having a hollow interior which receives the wafers, the contact portions extending within the housing nose portion on opposite sides of card-receiving slots formed therein;

the housing including first and second engagement members disposed on two distinct surfaces of the nose portion, each of the first and second engagement members including a recess that extends lengthwise of the housing, the recesses being aligned with the wafers such that the first and second recesses are disposed proximate to the terminal contact portions, wherein the housing is configured to engaging a guide frame and a shield.

9. The subassembly of claim 8, wherein the first and second recesses are respectively disposed on a lower surface and an upper surface of the nose portion.

10. The subassembly of claim 9, wherein the first recess includes a plurality of flat surfaces angularly disposed therein so as to receive and engage a fastening nut therein.

11. The subassembly of claim 8, wherein the first and second recesses are aligned with each other along a common axis.

12. The subassembly of claim 11, where the first recess has an angled configuration so that in operation, the first recess forms a dovetail joint with the guide frame.

13. The subassembly of claim 12, wherein the second recess also has an angled configuration so that in operation, the second recess forms another dovetail joint with the guide frame.

* * * * *